United States Patent [19]

Haberl

[11] Patent Number: 4,500,253

[45] Date of Patent: Feb. 19, 1985

[54] SIDE-CHANNEL PUMP

[76] Inventor: Johann K. Haberl, Fiskarholmsgränd 2, S-127 41 Skärholmen, Sweden

[21] Appl. No.: 433,136

[22] PCT Filed: Feb. 10, 1982

[86] PCT No.: PCT/SE82/00037

§ 371 Date: Sep. 23, 1982

§ 102(e) Date: Sep. 23, 1982

[87] PCT Pub. No.: WO82/02748

PCT Pub. Date: Aug. 19, 1982

[30] Foreign Application Priority Data

Feb. 10, 1981 [SE] Sweden ..... 8100913

[51] Int. Cl.[3] ..... F04D 5/00

[52] U.S. Cl. ..... 415/53 T; 415/213 T

[58] Field of Search ..... 415/53 T, 213 T, 119

[56] References Cited

U.S. PATENT DOCUMENTS

| | | | |
|---|---|---|---|
| 2,842,062 | 7/1958 | Wright | 415/213 T |
| 3,973,865 | 8/1976 | Mugele | 415/213 T |
| 4,204,800 | 5/1980 | Bentele et al. | 415/213 T |
| 4,376,613 | 3/1983 | Schoenwald | 415/53 T |

FOREIGN PATENT DOCUMENTS

| | | | |
|---|---|---|---|
| 370369 | 4/1973 | U.S.S.R. | 415/53 T |

*Primary Examiner*—Henry C. Yuen
*Assistant Examiner*—John Kwon

[57] ABSTRACT

A side-channel pump comprising an open impeller (11) and a side-channel (13A; 13B) formed with a semi-circular side wall and having an inlet (14) and an outlet (15). Between the inlet and the outlet there is provided a bead (21) projecting substantially axially into the side-channel, which is located in the vicinity of the inlet and has a height which ranges from about 25% to about 40% of the internal radius of the side-channel.

5 Claims, 6 Drawing Figures

SIDE-CHANNEL PUMP

Figure 1:
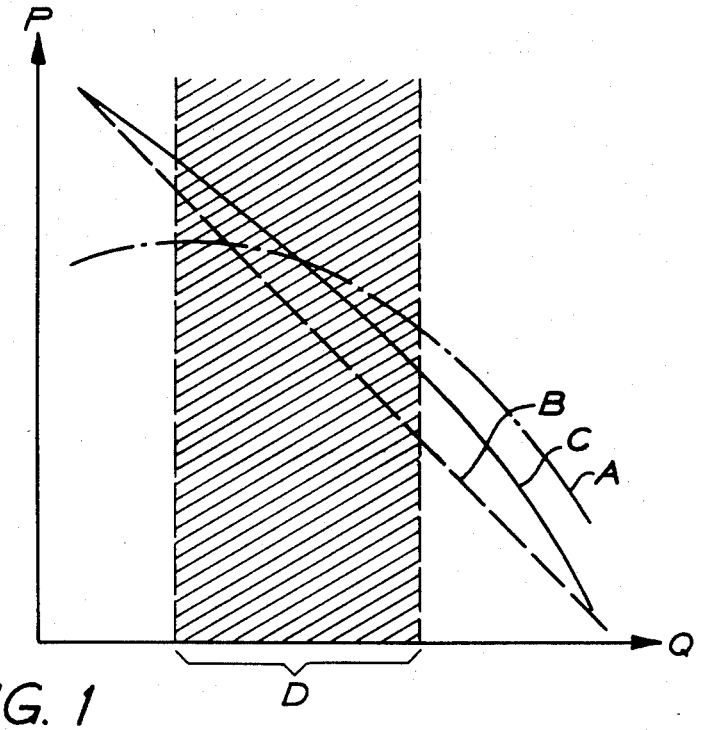

The invention relates to a side-channel pump comprising an open impeller and a side-channel formed with a semi-circular side wall and having an inlet and an outlet and a bead projecting substantially axially into the side-channel, which is located between the inlet and the outlet.

Contrary to the centrifugal pump the side-channel pump has a flow rate/pressure characteristic according to which maximum pressure is obtained at zero flow rate. The side-channel pump consumes maximum power at this maximum pressure. E.g. DE-A-15 28 822 discloses a solution of the problem to reduce the pressure at lower flow rates. The side-channel pump shown and described therein is of the type referred to above, and in that case the purpose of the bead is to provide a modified extension of the flow rate/pressure characteristic which for the side-channel pump having no bead normally is a straight line, i.e. the pressure increases linearly at decreasing flow rate. In one embodiment, several individual beads are provided one after the other in the side-channel, which extend substantially in the circumferential direction of the side-channel, and in another embodiment a single bead is provided concentrically with the side-channel. The bead or beads, respectively, are located in the central region of the side-channel only and extend axially over a quite long distance towards the impeller, the bead or beads, respectively, having a height amounting to $\frac{1}{2}$ to $\frac{3}{4}$ of the depth of the side-channel.

According to DE-B-27 14 459, the purpose of the bead of a side-channel pump of the type referred to is to attenuate effectively the sound arising due to cavity resonance. In that case the bead is located substantially centrally between the inlet and the outlet of the side-channel and, considering the flow loss, the height thereof is limited to a maximum of 25% of the depth of the side-channel.

The purpose of the invention is primarily to provide a side-channel pump of the type referred to above having a bead in the side-channel, which is particularly well suited for use as a suction source e.g. in a vacuum cleaning apparatus. In this application, the side-channel pump often has to operate in the most central region of the flow rate/pressure characteristic, but at some occasions it is necessary to use the maximum subatmospheric pressure. When heavy objects have to be sucked up, this high subatmospheric pressure is needed for transporting the object through the suction conduit to the separator, and at an obstruction, if any, in the suction conduit causing a flow rate of substantially zero, the high subatmospheric pressure is needed in order to make possible that the material forming the obstruction in the suction conduit is sucked away. Thus, there is a need of a side-channel pump which has a high subatmospheric pressure at zero flow rate and at the same time has high pressure values in the most central region of the characteristic. This need shall be satisfied by the invention, and this is achieved by the side-channel pump of the type referred to above. The side-channel pump according to the invention comprises an open impeller; a side-channel formed with a semi-circular side wall and having an inlet and an outlet; and a bead projection substantially axially into the side-channel and located between the inlet and the outlet at an angular distance from the center of the inlet (as seen in the rotational direction of the impeller) of about 1/5 of the arc over which the side-channel extends from the center of the inlet to the center of the outlet, and preferably is located about 90° from the center line between the inlet and the outlet and having a height of about 25% to about 40% of the internal radius of the side-channel.

Figure 2:
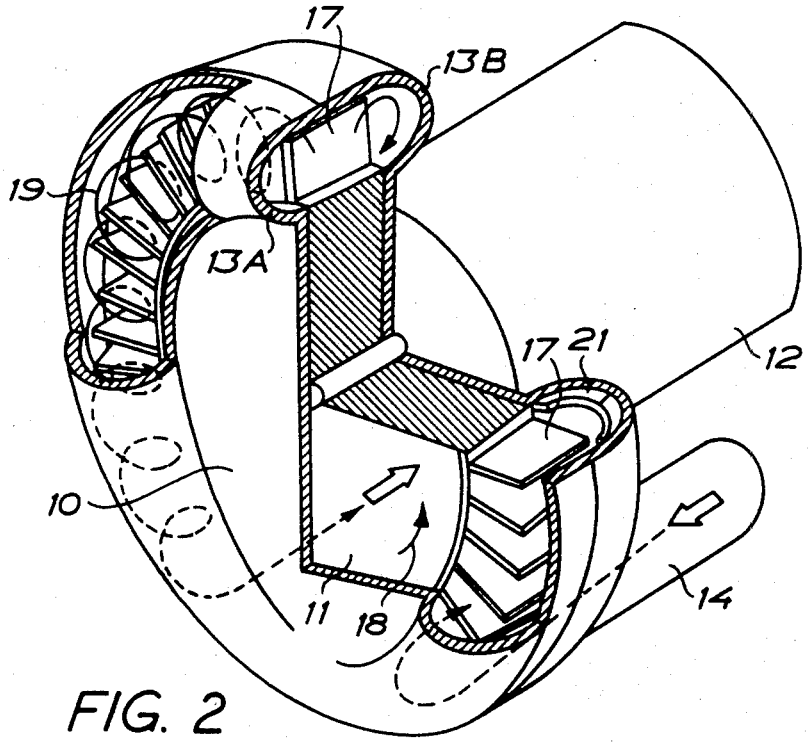
Figure 3:
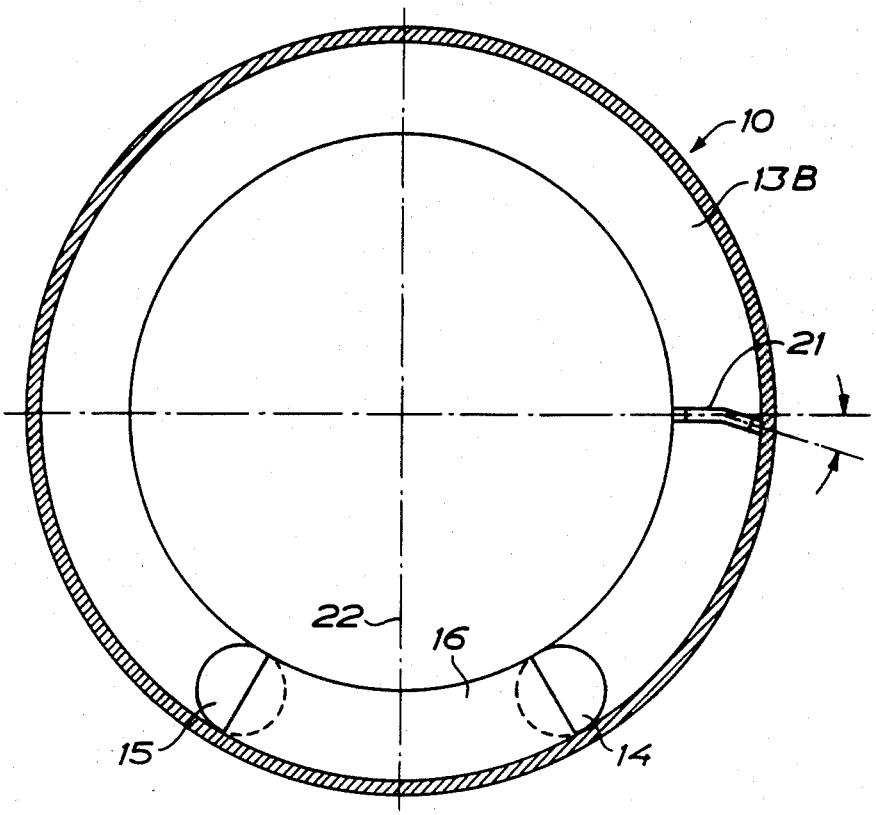
Figure 4:
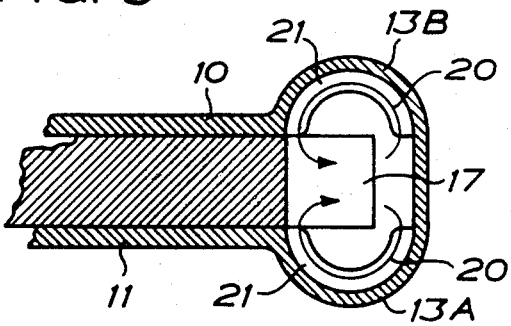
Figure 5:
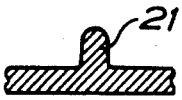
Figure 6:
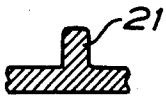

The invention will be explained in more detail with reference to the accompanying drawings in which FIG. 1 is a flow rate/pressure chart, FIG. 2 is a perspective view, partly a cross-sectional view, of an embodiment of the side-channel pump according to the invention, FIG. 3 is a cross-sectional view of the pump housing taken centrally through the pump housing transversely of the rotational axis of the impeller, FIG. 4 is a fragmentary radial cross-sectional view of the side-channel pump, FIG. 5 is a cross-sectional view of the bead and the wall of the side-channel and illustrates one embodiment of the bead, and FIG. 6 is a cross-sectional view similar to FIG. 5 but of another embodiment of the bead.

FIG. 1 shows typical flow rate/pressure characteristics for different types of pumps. The flow rate is designated Q ($m^3/h$) and is indicated along the horizontal axis while the pressure p ($mmH_2O$) is indicated along the vertical axis of the chart. In comparison the typical characteristic of a centrifugal pump has been shown in the chart, and this characteristic is designated A. For a side-channel pump having no bead in the side-channel the typical characteristic is such as represented by the straight line B while there can be obtained for a side-channel pump having the bead in the side-channel arranged according to the invention, the characteristic designated C. The operating region of a pump which is used in a vacuum cleaning apparatus e.g. for industrial vacuum cleaning, is located in the central region of the flow rate/pressure characteristic and is indicated in FIG. 1 by a hatched region D. As will be seen from the chart, there is obtained by the invention a considerable improvement of the pressure in the actual operating region as compared with the conventional side-channel pump having no bead. The characteristic for the side-channel pump according to the invention furthermore has a more favourable extension in this region than the characteristic for the centrifugal pump.

The side-channel pump by which the flow rate/pressure characteristic C in FIG. 1 is obtained, is shown in FIG. 2 and comprises a pump housing 10 with an impeller 11 rotatably mounted therein, said impeller being drivingly connected to an electric drive motor 12. The pump housing 10 is formed with double side-channels 13A and 13A and 13B which are substantially semicylindrical, and an inlet 14 and an outlet 15 opening through the wall of the side-channel 13B, are connected to the side-channels. Between the inlet and the outlet the side-channels are interrupted by a portion 16. The impeller 11 is an open impeller having a number of vanes 17 equally spaced along the periphery thereof; the outer half of said vanes may be angled in the rotational direction of the impeller, which is indicated by an arrow 18. The side faces of the vanes 17 pass closely to the portions 16 located one at each side of the impeller, between the inlet 14 and the outlet 15.

When the impeller 11 is rotated in the direction of the arrow 18 by means of the motor 12, air is sucked in through the inlet 14 by means of the vanes 17 of the impeller and is brought to flow along the side-channels 13A and 13B to the outlet 15. The flow is turbulent, i.e. the air moves substantially along a helical path through each side-channel and the adjacent portions of the spaces between the vanes 17 as has been indicated by a line 19 in FIG. 2 and by arrows 20 in FIG. 4. The surface of the impeller between the adjacent vanes 17 can be adapted to the generated air flow. So far the side-channel pump according to the invention principally is of an embodiment known per se.

In each side-channel 13A and 13B, respectively, a bead 21 is provided which extends along the entire wall of the side-channel and has a height which can vary from about 25 to about 40% of the internal radius of the side-channel. The bead is located about 90° as seen in the rotational direction 18 of the impeller 10 from the centre line 22 between the inlet 14 and the outlet 15 which should be located as close to each other as possible but must be separated to such extent that the leakage losses therebetween are kept at an acceptable low level. In the present case the angle between them is about 50°. In the embodiment shown, said location of the bead 21 means that the bead is located about 65° from the centre of the inlet 14. Thus, the bead is located in the vicinity of the inlet 14. The angular distance between the bead 21 and the centre of the inlet 14 is only about 1/5 of the angle over which the side-channel extends from the centre of the inlet 14 to the centre of the outlet 15 (about 65° and about 310°, respectively).

In order to reduce the flow loss at the bead 21 it is suitable to have a bead which follows a helical path corresponding to the helical path of the turbulent air flow passing through the side-channel. Alternatively, the radially outer portion of the bead can be angled in a direction opposite to the rotational direction of the impeller and the flow direction of the air, respectively, as shown in the drawings, FIG. 3, wherein the bead forms an angle which substantially corresponds to the pitch of the air flow. The angle designated $\alpha$ in FIG. 3 can range from about 10° to about 30°.

The bead 21 can have a rounded edge as shown in FIG. 5, or a flat edge as shown in FIG. 6.

The bead 21 in the side-channel, arranged and located according to the invention, operates as a guide vane but affects only the outer part of the air flow passing through the side-channel, which due to the centrifugal force will not be returned to the impeller. Moreover, the bead provides an effective attenuation of the resonance sound, which can indeed be greater than that achieved according to DE-B-27 14 459. By these effects there is obtained an increased efficiency and an increased pressure in the normal operating range of the side-channel pump, designated D in FIG. 1, such that there is obtained a favourable flow rate/pressure characteristic C according to FIG. 1.

I claim:

1. Side-channel pump comprising an open impeller; a side-channel formed with a semi-circular side wall and having an inlet and an outlet; and a bead projecting substantially axially into the side-channel and located between the inlet and the outlet at an angular distance from the center of the inlet as seen in the rotational direction of the impeller of about 1/5 of the arc over which the side-channel extends from the center of the inlet to the center of the outlet and having a height of about 25% to about 40% of the internal radius of the side-channel at least a portion of the bead extending helically in the rotational direction of the gas flow passing through the side channel at a pitch angle ranging from about 10° to about 30° .

2. Side-channel pump as claimed in claim 1 in which the radially outer portion of the bead is angled towards the inlet at a pitch angle ranging from about 10° to about 30° .

3. Side-channel pump according to claim 1 in which the bead is located about 90° from the center line between the inlet and the outlet.

4. Side channel pump comprising an open impeller; a side-channel formed with a semi-circular side wall and having an inlet and an outlet and a bead, the wall of the side-channel as well as the bead being semi-circular; the bead projecting substantially axially into the side channel and located between the inlet and the outlet at an angular distance from the center of the inlet as seen in the rotational direction of the impeller of about 1/5 of the arc over which the side-channel extends from the center of the inlet to the center of the outlet and having a height of about 25% to about 40% of the internal radius of the side-channel.

5. Side-channel pump according to claim 4 in which the bead is located about 90° from the center line between the inlet and the outlet.

* * * * *